United States Patent [19]

Jysky et al.

[11] 3,975,831

[45] Aug. 24, 1976

[54] DIRECTING INSTRUMENT

[75] Inventors: Goran Jysky; Ilmar Mardla; Bjorn Ericsson, all of Nykoping, Sweden

[73] Assignee: Ilmeg AB, Nykoping, Sweden

[22] Filed: July 31, 1974

[21] Appl. No.: 493,374

[30] Foreign Application Priority Data

Aug. 2, 1973 Sweden ..... 7310672
Oct. 31, 1973 Sweden ..... 7314833

[52] U.S. Cl. ..... 33/333; 33/341; 33/349; 33/366; 33/370; 33/395; 33/397; 33/401

[51] Int. Cl.[2] ..... B23B 49/00; G01C 9/14; G01C 9/16

[58] Field of Search ..... 33/310, 312, 313, 333, 33/340, 341, 349, 351, 366, 370, 391, 395, 397, 401, 402

[56] References Cited

UNITED STATES PATENTS

| | | | |
|---|---|---|---|
| 1,289,904 | 12/1918 | Poor | 33/349 |
| 2,437,132 | 3/1948 | Sinks | 33/363 Q |
| 2,464,911 | 3/1949 | White | 33/397 |
| 2,834,118 | 5/1958 | Jackson | 33/395 |
| 3,167,049 | 1/1965 | Foster | 33/397 |

*Primary Examiner*—Richard E. Aegerter
*Assistant Examiner*—Steven L. Stephan
*Attorney, Agent, or Firm*—Fred Philpitt

[57] ABSTRACT

A directing instrument for control of the inclination of the drill post of a drilling apparatus comprising means for sensing the inclination of the post in two directions at right angles to one another. Said means being supported by a holder arranged to be mounted rotatably on said post and so that the axis of rotation of said holder can be set relative to the post dependent on the type of operation to be carried out.

10 Claims, 4 Drawing Figures

DIRECTING INSTRUMENT

This invention relates to a directing instrument for the setting and/or control of the inclination or direction of the drill post of a drilling apparatus, the frame of a piling machine, or the like. The instrument includes means for sensing the inclination of the post or frame in two directions.

Known instruments for setting the inclination of drill posts or the like normally include a pendulum system or a level system fixed to the drill post. The pendulum systems include generally a graded disc against which the deflection of a pendulum is read, while the level systems being read by observing the position of a bubble in a viewing window. Both these readings must be taken at the instrument and normally with the drilling machine stopped. This means that the setting of the drill post becomes very time-wasting and uncertain, and that control of the inclination of the post during drilling is difficult to carry out since the operator must switch off the drilling machine and leave the control position of the drilling apparatus for each reading of the instrument, which on difficult terrain and in wet weather also results in increased risk of accident. There is an instrument on the market which attempts to solve this problem by optical measurement. This instrument, however, makes it possible to measure only one angle, which is often not sufficient. Other attempts to solve the problem have resulted in designs of an advanced type, which will be very expensive and make control of the drill post difficult.

Further, known instruments of simple design which are fixed to the drill post can only be employed except for in association with the drilling of vertical holes, i.e. holes that are not to be inclined in any direction in drilling inclined holes, where the desired inclination of the holes is known in a direction that forms a right angle to one of the sensing axes of the sensing means. For example, in the construction of roads a number of holes must be drilled along a marked-out line, the so-called edge joint whose holes must normally display a pre-determined inclination in a direction at right angles to the said line. When drilling along such a line, the drill carriage is usually driven up against it, after which a number of holes are drilled with the vehicle remaining in the same position, the drill post being swung laterally between the various holes, thereby avoiding unnecessary shifting of the carriage. If the instrument is fixed to the drill post and its sensing axes are directed straight ahead and at right angles laterally to the post the instrument will, however, show the correct number of degrees only in those cases where the drill post is directed at right angles to or parallel to the marked-out edge joint. When the post is between these positions, the angles measured by the instrument will however deviate from those angles that the post forms with the edge joint in a direction at right angles to it because of the holder of the instrument and thus its sensing axes having been rotated in relation to the edge joint.

One object of the invention is to make a simple, robust and reliable directing instrument which provides accurate setting and/or control of the inclination or direction of a drill post or the like when drilling vertical as well as inclined holes.

Another object of the invention is to provide a directing instrument which makes it possible for the operator to set and/or control the inclination of a drill post, the frame of a piling machine or the like from a remote control position.

To meet the first objects, the instrument includes, according to the invention, a holder supporting the desired sensing means arranged to be mounted rotatably to the drill post or corresponding part in such a manner that the axis of rotation can be set relative to the post dependent on the type of operation to be carried out. For the second object means are also provided for rotation of the holder from a remote control position and for transferring the deflections of the sensing means to an indicating device located at said control position.

Other designs and characteristics of the invention are apparent from the sub-claims.

The invention will be described in more detail below by reference to the accompanying drawings.

Figure 1:
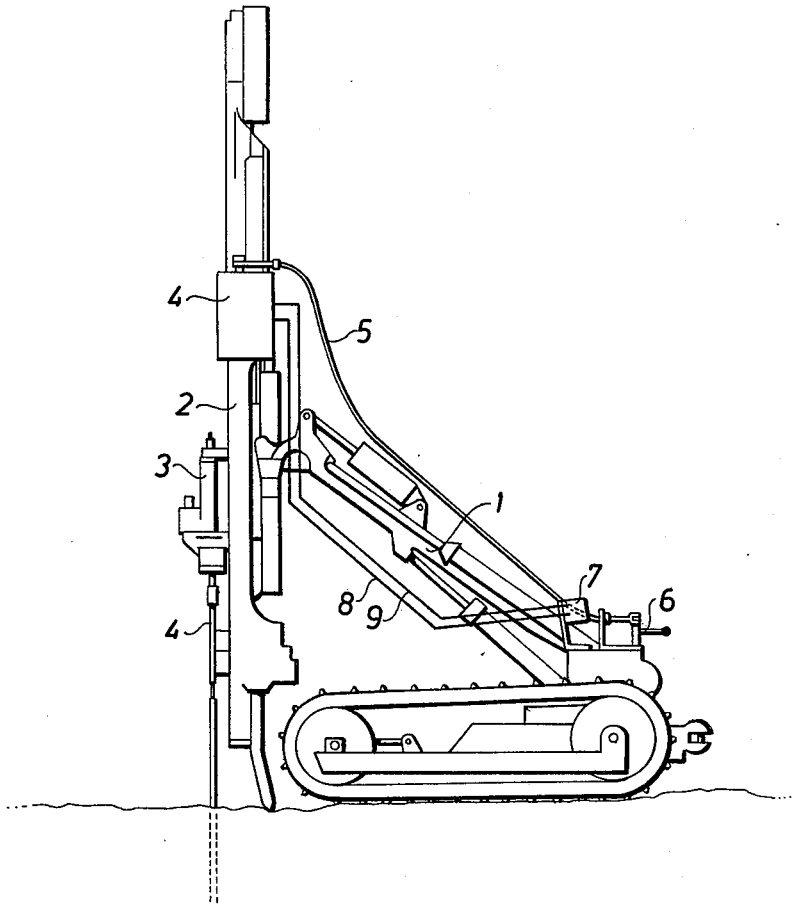
FIG. 1 shows diagrammatically a drilling apparatus mounted an a drill carriage and provided with a directing instrument according to the invention.

A drilling apparatus according to FIG. 1 includes a drill post 2 supported by a boom 1, a drilling machine 3 being displaceably mounted on the post. Since drilling apparatuses of this type are well known, a detailed description of this will not be given. The drilling apparatus shown has been provided with a directing instrument according to the invention consisting of an instrument box 4 rotatably secured to the drill post 2 and including sensing means for sensing the inclination of the post in two directions at right angles to one another. The box 4 is rotatably secured to the drill post and can be rotated from the control position of the carriage via a cable 5 and an operating lever 6. At the said control position, an instrument 7 connected to the instrument box 4 via two signalling leads 8 and 9 has been provided for indicating the angles measured by said sensing means.

Figure 3:
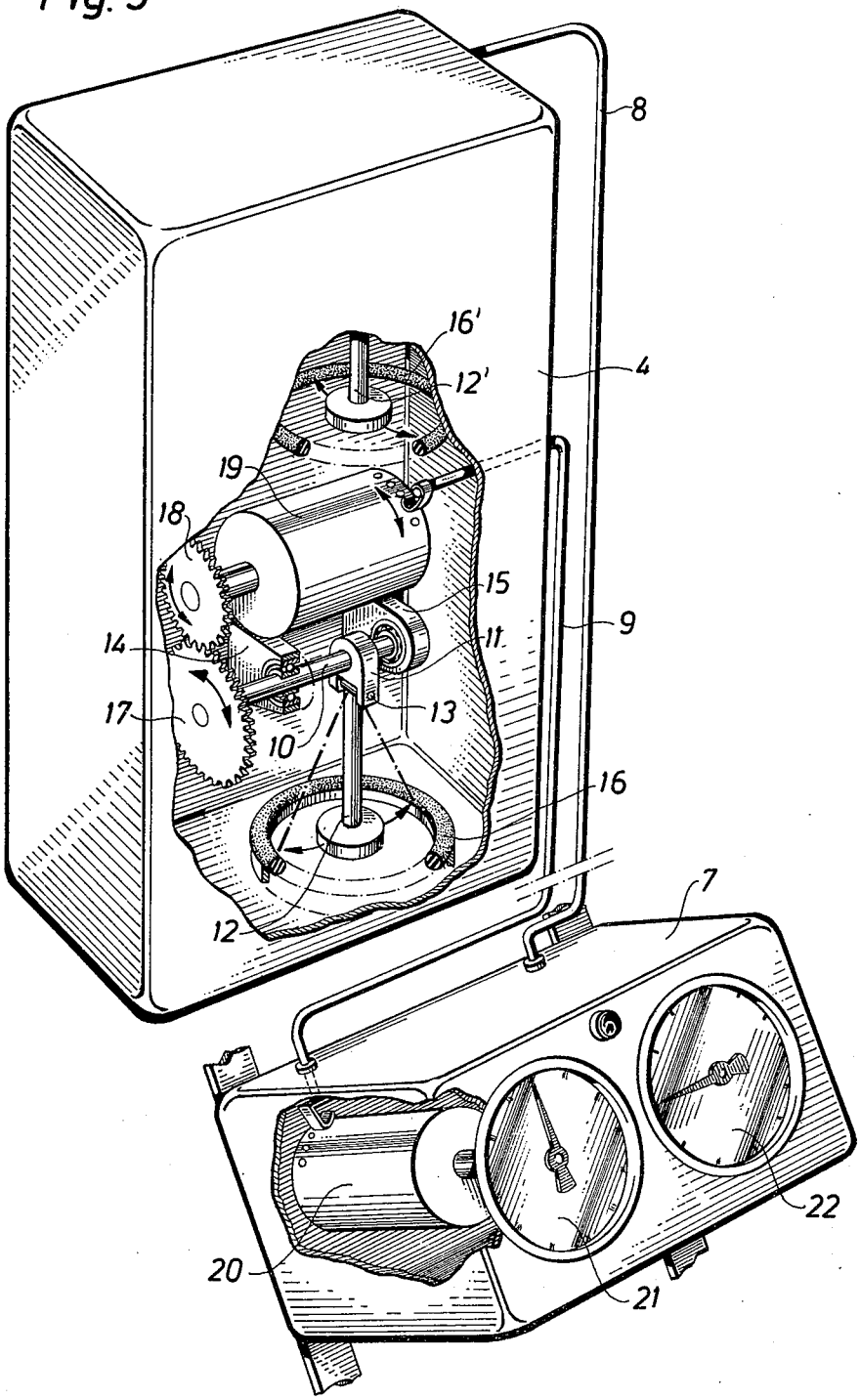
FIG. 3 shows one embodiment of the sensing means arranged to be mounted on the drill post and the indicating device located at the control position of the drilling apparatus.

According to FIG. 3, the instrument box 4 comprises two pendulum systems, one above the other. Of the upper system, only pendulum 12' can be seen in the drawing, together with a damping ring 16'. Both pendulum systems are, however, completely identical, and therefore only the lower will be described, although they are orientated at right angles to one another to make it possible to measure the inclination of instrument box 4 in two directions at right angles to one another.

The pendulum system shown comprises a pendulum 12 provided on a shaft 10 via a yoke 11. The pendulum is rotatably secured to the yoke by means of a pin 13. The yoke 11 is fixed to the shaft 10, which in turn is supported by two bearings 14 and 15. The shaft 10 is preferably arranged parallel to one of the side walls of the box 4. The suspension shown of the pendulum 12 results in its being able to rotate freely in a direction parallel to the shaft 10, this direction being shown by arrows in the drawing. The rotating movement is, however, restricted by a damping ring 16 provided around the lower part of the pendulum. If now the instrument box is inclined at right angles to the former direction, the pendulum deflection will cause a rotation of the shaft 10, this rotating movement being transferred via pinions 17 and 18 to the rotor shaft of an inductive transmitter 19, such as a torque transmitter. The signal from the transmitter 19 is transferred via a signalling lead 9 to a corresponding receiver element 20 which operates an indicator instrument 21 to indicate the inclination of the box 4 at right angles to the shaft 10. In a corresponding manner, the upper pendulum system, which is so arranged in the instrument box 4 that its shaft forms a right angle with the shaft 10 of the lower pendulum system, will emit a signal on the lead 8 which corresponds to the inclination of box 4 at right angles to the shaft in the upper pendulum system, i.e. parallel to the shaft 10 in the lower system shown. Said signal is transferred via lead 8 to a driving unit for an indicator instrument 22.

Figure 2:
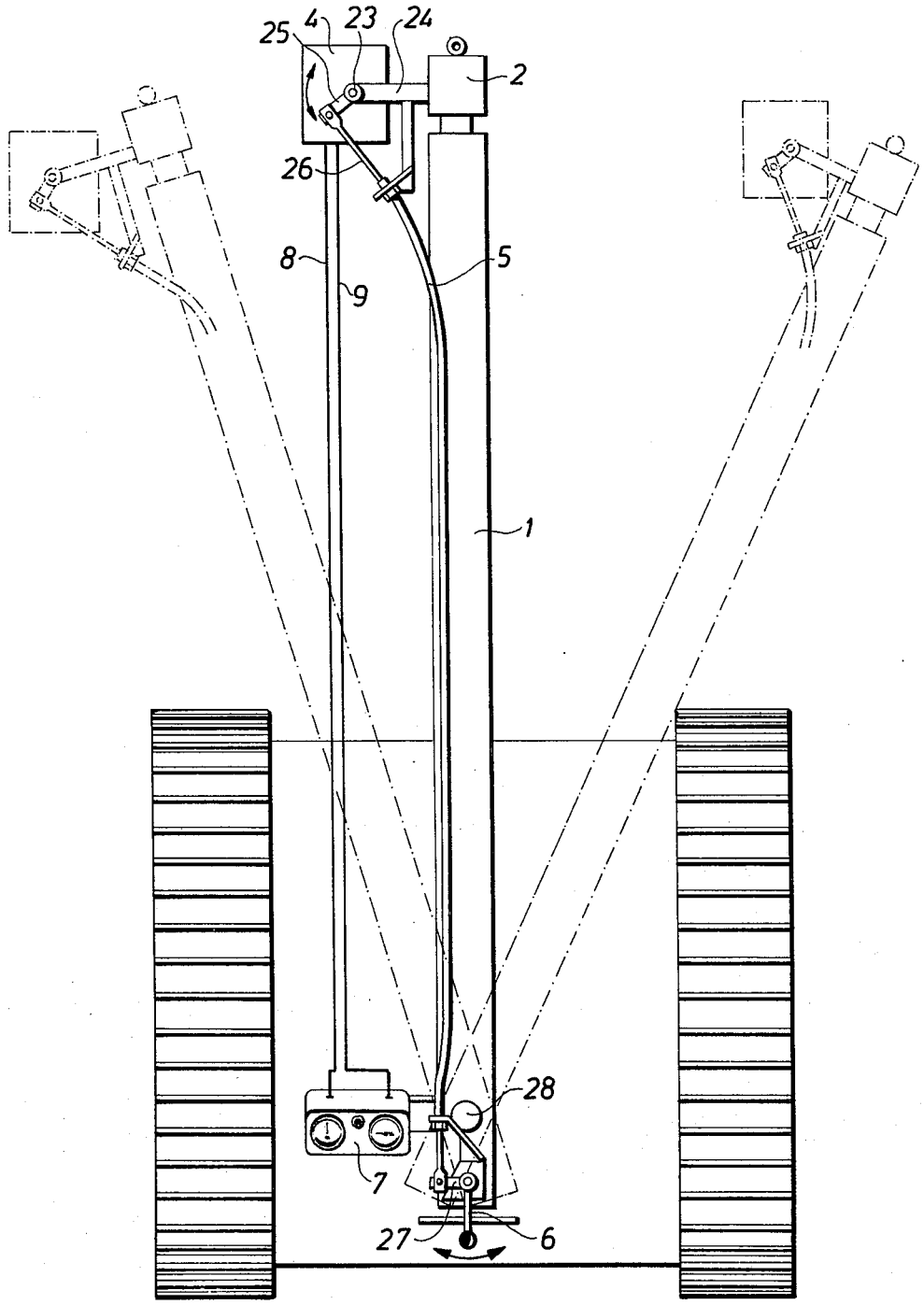
FIG. 2 shows diagrammatically the apparatus according to FIG. 1, viewed from above.

By providing the instrument box 4 on the drill post according to FIG. 1 and 2 and by placing the indicating unit 7 with indicator instruments 21 and 22 at the control position of the drilling apparatus, the inclination of the drill post can thus be controlled continuously during an adjustment operation, and in further drilling from the same position from which the drilling carriage and the drilling machine is in general controlled. This leads, inter alia, to considerable simplification of the adjustment of the inclination of the drill post when starting a new hole. Also, the risk of accident is reduced and precision increased, making it possible for the distance between the drilling holes to be increased, which is important as concerns timesaving and cost. The pendulum systems described are of a very robust construction to withstand the severe conditions they are subject to in practice. Among other points, it should be noted that the pendulums are not provided directly on the rotor shaft of the torque transmitter, this having been relieved of the weight of the pendulum and being driven instead via the pinions 17 and 18. This also means that a relatively heavy pendulum can be employed, further improving accuracy. The oscillations of the pendulum can be damped in various ways, for example by mechanical, electrical or magnetic means. In a preferred embodiment, damping is secured by filling the entire instrument box with oil. The instrument can also be so designed that the damping ring 16 can be simply exchangable for rings of other diameters adapted to certain special applications.

Although the instrument box 4 according to FIG. 3 is shown to consist of a single large chamber containing both pendulum systems, these can with advantage be built into separate oil-filled containers which are then installed in a larger non-oil-filled instrument box 4. In this manner only one type of pendulum system need be manufactured which, when fitted in the outer instrument box, can be rotated 90° relative to one another in the manner described. The instrument box 4 shown is of parallel-epipedic shape, but can with advantage be designed as a cylinder and furnished to receive two identical, equally cylindrical, oil-filled containers, each incorporating its pendulum system. The cylindrical outer container is thereby suitably provided with external markings or direction lines indicating the directions of the shafts of the pendulum systems fitted. With cylindrical containers, the damping ring can be omitted and the lower sections of the pendulums covered with damping material after which they can be allowed to strike against the side walls of the container. The embodiment with the pendulum systems enclosed in separate oil-filled inner containers that are easily exchangeable gives great advantages from both service and reliability points of view.

Figure 4:
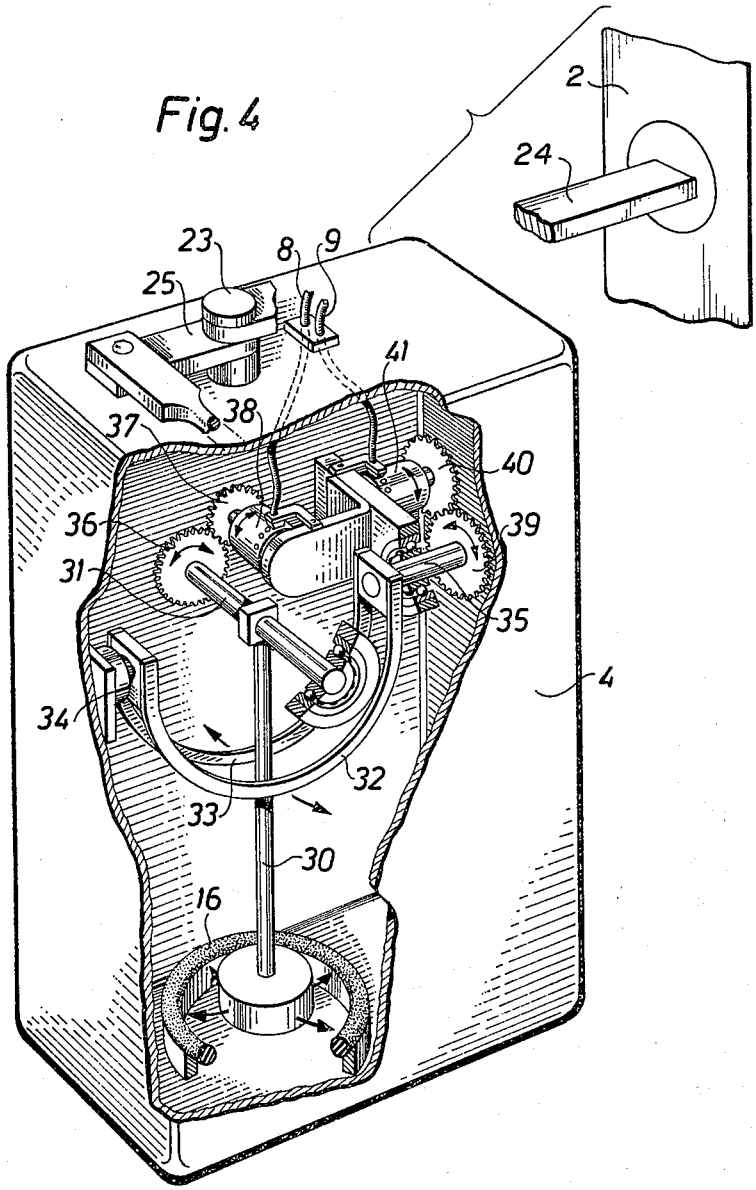
FIG. 4 shows a second embodiment of the sensing means according to the invention.

FIG. 4 shows an other preferred embodiment of a pendulum system for sensing the inclination of the drill post. This system comprises only one pendulum 30 which is enclosed in the instrument box 4. Said box is like the embodiment described above arranged to be mounted rotatably on the drill post by means of shaft journals 23. For remote control an arm 25 is provided on one of said journals which arm is intended to be connected to an operating lever at the control position of the drilling apparatus, for instance via flexible cable.

The pendulum 30 in the box 4 is unrotatably connected to a shaft 31 freely carried in the box. The suspension of the pendulum 30, however, enables this to rotate in the longitudinal direction of the shaft 31. The pendulum is surrounded by two wires or bars 32 and 33 respectively, which are bent in the vertical plane and which at both ends are unrotatably connected with two journals 34 and 35, respectively, freely positioned in the instrument box, said journals defining a torsional axis at right angles to the shaft 31. Attached to the shaft 31 is a pinion 36 which via a second pinion 37 drives the rotor of an inductive transmitter 38. In a corresponding manner the journal 35, via pinions 39 and 40, drives the rotor of a second inductive transmitter 41. The signals given by the transmitters 38 and 41 are transferred via leads 8 and 9 respectively to indication instruments provided at the control position of the drilling apparatus. The oscillations of the pendulum are limited by a rubber ring 16.

The function of the above-described pendulum system is as follows. When the drill post carrying the instrument box 4 is inclined in a direction at right angles to the shaft 31 a signal corresponding to this inclination will be generated by the transmitter 38 and transferred via the lead 8 to the indication instrument referred to. When the drill post is inclined in the longitudinal direction of the shaft 31 the pendulum 30 will bring the bow-shaped wires or bars 32 and 33 respectively into motion, which will result in the transmitter 41 sending a signal corresponding to the inclination in this direction, which will be transferred via the lead 9 to the location instrument referred to.

The pendulum system including only one pendulum described above will thus give the same information as the two interacting pendulum system previously described. The rotatability of the holder makes it possible in this case also always to measure the angles of inclination in the wanted directions.

The type of inclination-sensing device thus has no influence on the fundamental principle according to the invention to design the holder for the inclination-sensing device so that it can be rotated at the drill post and controlled from a remote position. The control of the holder is naturally not limited only to be possible by means of mechanical devices such as a flexible cable but can also take place by any other means, e.g. with the aid of electric motors, in which case the control signals are transmitted via electric wires.

When permanently fitted to the drill post, an instrument according to the above shows the inclination of the post in two directions determined by the orientation of the pendulum shafts. When holes are to be drilled having a certain inclination, the inclination of the hole is often not known in precisely these directions, which is the case for example when drilling a number of holes along an edge joint of a road section with the drilling vehicle stationary and employing the pivotability of the boom and the post. According to the invention, the instrument box 4 is therefore designed so that it can be arranged rotatably around a suitable shaft. Means are also provided for controlled rotation of the box from the normal control position of the drilling apparatus.

FIG. 2 shows the principle of a device permitting such a rotation of the instrument box applicable to a drilling apparatus according to FIG. 1, comprising a boom 1 and a drill post 2. At the drill post 2, the instrument box 4 has been rotatably positioned around an upper and a lower journal 23, these journals being mounted in a fork-shaped bracket 24, rotatably mounted on the drill post as described below. At one of the journals 23, a radially extending arm 25 has been provided whose outer end is connected to a stainless steel cable 26 with a flexible outer cover, a so-called Bowden cable. The other end of the steel cable 26 is fixed to an arm 27 extending in a corresponding manner from an operating lever 6. The operating lever 6 is positioned in an operating lever bracket adjacent to the bearing point of the boom in the drilling carriage. Arms 25 and 27 are appropriately of equal length, so that a certain rotation of the operating lever 6 results in a corresponding rotation of the instrument box 4 around the journals 23. The operating lever can be designed in the form of a cross and be employed to aim the instrument box at right angles or parallel to a marked-out line, for example the edge joint of a road section. In this way, correct angels can be read off irrespective of the position of the carriage and the setting of the boom.

With the device shown, it can be brought about that the instrument box 4 — after an initial basic stteing — sets itself automatically in the correct position when the boom 1 is swung. In this case the bracket of the operating lever 6 should be positioned at the vertical shaft 28 around which the boom is swung, and the drilling carriage provided with suitable means for locking the operating lever in the desired position relative to this. In practice, the drilling carriage can then be placed at any desired angle in relation to, for example, an edge joint, after which the instrument box is set at right angles to this. When this is done, the operating lever 6 is locked in the position adapted relative to the drilling vehicle. Upon subsequent swinging of the boom, the instrument will retain its alignment relative to said edge joint due to the relative movement between boom and carriage, this movement being transferred via the steel cable to the instrument box. This gives substantially more rapid and exact setting of the drill post when drilling a number of holes along a marked-out line with the drilling carriage remaining in a certain position.

The instrument described above provides a considerably simplified and thus more rapid and exact setting of the post when starting new holes, compared with the technique used in practice today. Among other things, it makes it simple to correct the faults that can arise at the start of a new hole due to the drilling carriage — after the adjustment of the drill post — having changed its position somewhat in connection with the loading of the drill. The continuous control of the angles of inclination during drilling provided by the instrument also makes it possible rapidly to correct minor faults that may arise.

Apart from for control of the drill inclination when drilling vertically downwards, the device can also be used in connection with drilling upwards and horizontally by rotating the holding bracket 24 around a horizontal axis. Although not clearly shown in FIG. 2 the holding bracket 24 for the instrument box 4 is arranged to be rotatable relative to the post 2 so that the axis of rotation of the box 4 can be set relative to the post dependent on the type of drilling to be carried out. Thus, when drilling holes downwards the shaft journals 23 of rotation of the box 4 is preferable set in parallel to the post as shown. For drilling horizontal holes the holding bracket 24 of the box is rotated 90° around a horizontal axis so that the shaft journals 23 of rotation of the box will be vertical and for drilling holes upwards the bracket is rotated additional 90° around the same axis. However, the rotational shaft journals 23 of box 4 can by means of bracket 24 also be set at any wanted angle between these which for instance is of great importance when using the instrument in mining.

The embodiment described and illustrated should be seen only as an example of the invention, which can be varied in many respects within the framework of the patent claims. For example, the number of pendulum systems and their direction can vary relative to the object for which they are to sense the inclination. Indication can be effected as desired, and an instrument provided with a switchover device can for example be used to show the inclination in several directions.

What we claim is:

1. The arrangement which comprises in combination a. a mobile carrier in the nature of a tractor, or the like, b. a drill post or pile driving mechanism mounted on one portion of said mobile carrier, c. sensing means for sensing the inclination of the post or pile driving mechanism in two directions that are perpendicular to each other, said sensing means including at least one pendulum system, d. a holder for said sensing means, e. said holder being attached to said drill post or pile driving mechanism by a connecting member, said connecting member being rotatable about a general horizontal axis, f. said holder being attached to said connecting member so that it can be rotated about an axis that is parallel to the axis of the drill post or pile driving mechanism, g. means remote from said post or pile driving mechanism for rotating said holder about an axis that is generally vertical, h. means for transmitting the inclination sensed by said sensing means to an indicating position on the mobile carrier that is remote from said post or pile driving mechanism.

2. An arrangement according to claim 1 wherein a container encloses said pendulum system and said container is filled with a damping liquid.

3. An arrangement according to claim 1 for control of the inclination of a drill post, having an operator's seat and an operating lever located adjacent the operator's seat, wherein said rotatable holder is connected to said operating lever via a flexible control cable.

4. Arrangement according to claim 3 wherein the operating lever is rotatably positioned at the point of rotation of a boom supporting the drill post, and lockable in a desired position.

5. An arrangement according to claim 3 wherein one end of the flexible control cable is secured to an arm extending from one of two journals arranged opposite to one another on said holder, the other end being secured to an arm extending from said operating lever.

6. An arrangement according to claim 5 wherein said arms are of the same length.

7. An arrangement according to claim 1 wherein said pendulum system includes a pendulum which is unrotatably attached to a rotatable shaft but arranged to be swingable relative to said shaft in the longitudinal direction thereof, and angle measuring means provided for measurement of both the rotation of said shaft and the oscillation of the pendulum in the longitudinal direction of said shaft.

8. An arrangement according to claim 1 wherein said pendulum system includes a pendulum and said pendulum is surrounded by two wires, bars or the like, bow-shaped in the vertical plate, which in the horizontal plane extend at right angles to said shaft and which at least at one of their ends are unrotatably connected to a rotatable journal perpendicular to said shaft, and angle measuring means are provided for measurement of the rotation of said journal.

9. An arrangement according to claim 1 wherein the pendulum system includes a pendulum and the deflections of the pendulum are arranged to be converted into electrical signals and transferred to indicating means located at an operator's control position located on said carrier.

10. An arrangement according to claim 1 wherein said pendulum system includes a pendulum and said pendulum is arranged to drive the rotors of two inductive transmitters and the indicating means are driven by corresponding inductive receivers.

* * * * *